US005115223A

United States Patent [19]

Moody

[11] Patent Number: 5,115,223

[45] Date of Patent: May 19, 1992

[54] PERSONNEL LOCATION MONITORING SYSTEM AND METHOD

[76] Inventor: Thomas O. Moody, 1616 Centaur Circle, Lafayette, Colo. 80026

[21] Appl. No.: 585,639

[22] Filed: Sep. 20, 1990

[51] Int. Cl.[5] ..... G08B 21/00; G08B 13/18

[52] U.S. Cl. ..... 340/573; 340/539

[58] Field of Search ..... 340/573, 539

[56] References Cited

U.S. PATENT DOCUMENTS

| | | | |
|---|---|---|---|
| 4,549,169 | 10/1985 | Moura et al. | 340/573 |
| 4,814,751 | 3/1989 | Hawkins et al. | 340/539 |
| 4,832,050 | 5/1989 | Dilullo | 340/573 |
| 4,862,144 | 8/1989 | Tao | 340/573 |
| 4,885,571 | 12/1989 | Pauley et al. | 340/573 |
| 4,952,913 | 8/1990 | Pauley et al. | 340/573 |
| 4,973,944 | 11/1990 | Maletta | 340/573 |
| 4,980,671 | 12/1990 | McCurdy | 340/573 |

*Primary Examiner*—Glen R. Swann, III
*Attorney, Agent, or Firm*—Rogers & Killeen

[57] ABSTRACT

A system and method for monitoring the location of an individual includes (a) a band attached to the individual that has a pressure actuated tamper indicator and (b) a monitoring/tracking unit that may be used to both monitor whether the individual has left a predetermined area and to provide an indication of the direction to the individual. The band may include a latch that applies pressure to a pressure sensitive pad when the latch is closed. When the latch is opened, pressure is removed and the transmitter may provide an indication that the band has been removed. The monitoring/tracking unit may include directional and omnidirectional antennae and a self-contained power source for portable operation of the unit.

27 Claims, 7 Drawing Sheets

PERSONNEL LOCATION MONITORING SYSTEM AND METHOD

BACKGROUND OF THE INVENTION

The present invention relates to systems for monitoring the location of personnel and property. More specifically, the invention is a system and method for locating an individual who has wandered away from their home and who is unable to return without assistance from others, such as a person afflicted with Alzheimer's disease.

Millions of older Americans suffer from Alzheimer's disease and studies indicate that this number may increase significantly in the next century. Most of the people with Alzheimer's and related disorders are cared for in the home where constant monitoring and care often pose a heavy burden on the caregiver. Frequently, the caregiver must leave the afflicted individual at home alone at high risk for wandering away from home or for accident. For many caregivers there is little option as they must leave the afflicted individual at home while they work or shop. Similarly, afflicted persons living in nursing homes must bear the heavy cost of attendants to monitor their movement. The present invention provides an option for the caregiver who must leave the afflicted individual at home and a means to reduce nursing home costs by providing a low cost system for monitoring the movements of afflicted individuals and, if the need arises, for locating an individual who has wandered away from their residence.

The physical and mental abilities of both the afflicted individual and caregiver are considerations in the design and operation of the present invention. For example, a transmitter that may be carried by the afflicted individual should be lightweight, unobtrusive and carry such designs and/or colors that may be acceptable to the afflicted individual so that they would be less likely to want to remove it. The transmitter should include features that prevent the inadvertent or unknowing removal of the device from the individual. A monitoring and tracking unit for home use should include features that enable operation by an unskilled person, such as a family member or neighbor.

Personnel location monitoring systems may include a radio frequency transmitter carried by the individual whose location is being monitored and a receiver unit at a monitoring location for providing an alarm when the individual wanders beyond the reception range of the monitoring unit. Such systems are the most basic when designed for home use. Typically, because of manufacturing cost and complicated operating procedures they do not include provisions for determining direction to the individual whose location is to be monitored, do not include provisions for preventing removal of the radio frequency transmitter from the individual and do not provide features for uniquely identifying the signal to enable multi-person monitoring capabilities. For example, see U.S. Pat. No. 4,785,291 to Hawthorne and U.S. Pat. No. 4,593,273 to Narcisse.

Systems designed for use by firemen, policemen and hospital/nursing home staffs may include a tracking capability. Such systems are generally complicated to use and include a separate tracking device. The separate tracking device may be used efficiently by a trained professional, but a distraught family member may find such devices unduly complicated in an emergency. Further, such devices may have fragile antenna elements inappropriate for home use. See, for example, U.S. Pat. No. 4,468,656 to Clifford et al. and U.S. Pat. No. 4,814,751 to Hawkins, et al.

The radio frequency transmitting device carried by the individual whose location is to be monitored may be affixed to the individual so that it cannot be removed by the individual. Such devices may include features for resisting tampering or features that indicate when tampering has occurred. Such devices are well known in electronic monitoring systems for prisoners at home. These devices, however, are typically bulky and include features to thwart the extreme measures that a home prisoner might take. Accordingly, such devices are expensive to build and inappropriate for use by an elderly person afflicted with Alzheimer's disease. See, for example, U.S. Pat. No. 4,777,477 to Watson, U.S. Pat. No. 4,885,571 to Pauley, et al. and U.S. Pat. No. 4,694,284 to Leveille, et al.

Accordingly, it is an object of the present invention to provide a novel personnel location monitoring system that is easy to use in the home and provides features commensurate with the physical and mental state of individuals having Alzheimer's and related diseases.

It is a further object of the present invention to provide a novel personnel location monitoring system that includes a device carried by the individual whose location is to be monitored that has a pressure sensitive latch for preventing removal of the device and for indicating when tampering has occurred.

It is another object of the present invention to provide a novel personnel location monitoring system with a single unit that provides both monitoring and tracking capability and is suitable for use in the home.

It is still a further object of the present invention to provide a novel personnel location monitoring system having a portable direction finding antenna connected to a monitoring unit, the antenna having three parallel elements carried on a rigid support that prevents damage to the antenna elements.

It is yet a further object of the present invention to provide a method of monitoring and tracking an individual carrying a transmitter that includes the capability to monitor and track the individual with a single portable unit with selectable directional and omnidirectional antennae.

These and many other objects and advantages will be readily apparent to one skilled in the art to which the invention pertains from a perusal of the claims, the appended drawings and the following detailed description of preferred embodiments.

DETAILED DESCRIPTION OF PREFERRED EMBODIMENTS

Figure 1:
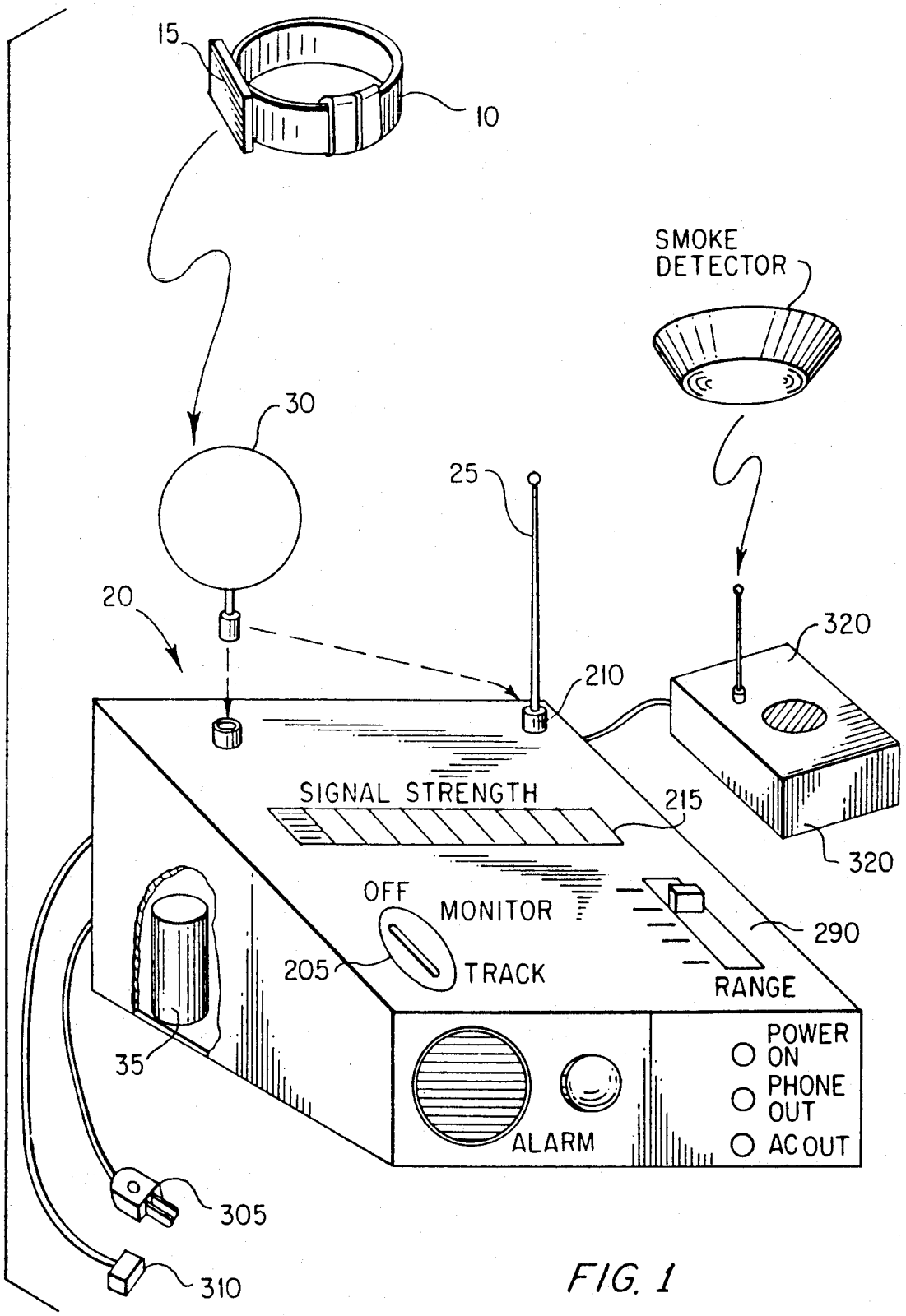
FIG. 1 is a pictorial representation of an embodiment of the personnel location monitoring system of the present invention.

With reference now to FIG. 1, the personnel location monitoring system of the present invention may include a band 10 adapted for attachment to the individual whose location is to be monitored, the band having a transmitter 15 for emitting an identifying signal and tamper resisting and indicating features as will be discussed below, and a monitoring/tracking unit 20 for receiving the identifying signal from transmitter 15 for indicating when the identifying signal has not been received for a predetermined period of time and for indicating a direction to the individual wearing the band 10. The unit 20 may include antennae 25 and 30 for omnidirectional and directional reception of the identifying signal and a self-contained power source 35 so that the unit 20 may be portably used.

The Band

The system of the present invention may include a band worn by the afflicted individual on the wrist, ankle or other suitable part of the individual. The band may also be attached to an article of clothing or personal item such as a wheelchair, albeit resulting in less resistance to tampering or separation from the individual.

Figure 2:
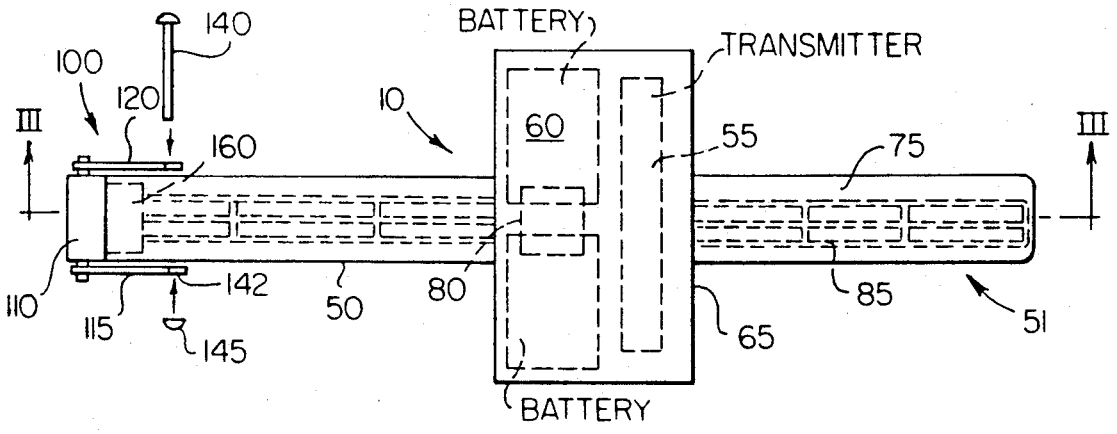
FIG. 2 is a partial schematic and partial pictorial representation of an embodiment of the band that may be used in the personnel location monitoring system of the present invention.
Figure 3:
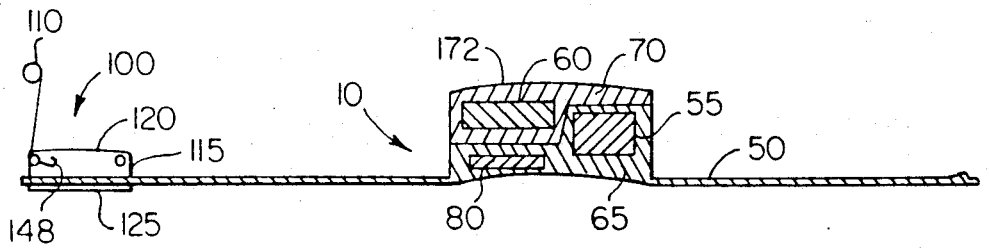
FIG. 3 is a cross sectional view through line III—III of FIG. 2.
Figure 4:
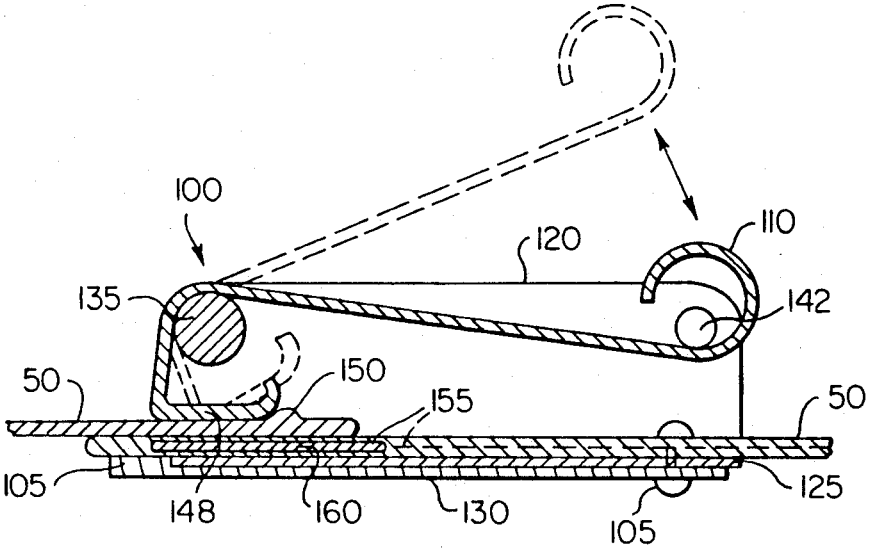
FIG. 4 is a cross sectional view of the latch of the band of the embodiment of FIG. 2.

With reference now to FIGS. 2, 3 and 4, the band 10 may include a strap 50 adapted to be worn by the afflicted individual, a transmitter 55 carried by the strap 50, one or more batteries 60 and one or more tamper resisting and/or indicating devices.

The strap 50 may be formed from a durable and flexible material, such as a thermo-plastic elastomer (for example, Hytrell TM made by DuPont or Lomod TM made by General Electric). The strap 50 may be injection molded in one piece and may include a case 65 for the transmitter 55.

The transmitter 55 may be a suitable, commercially available radio transmitter that transmits on a specific frequency of several hundred to several thousand megahertz. For example, the transmitter may be a thick 900 MHz thick film device that is frequency modulated. It is desirable that the transmitter be small and have a range of at least several miles. For example, a transmitter having a size of about $\frac{1}{4}'' \times \frac{1}{4}'' \times 2''$ with a range of about three miles has proven to be acceptable. To extend the life of the battery the transmitter may send pulsed signals. For example, the transmitter may send a signal about every ten seconds with a pulse width of about ten milliseconds. The time intervals between transmissions may be of randomly varying length. Further, conventional means may be used to synchronize the transmissions from two or more bands so that signals are not transmitted at the same time. The output during the pulse may be about three watts RF. The signal emitted by the transmitter may uniquely identify the individual wearing the band. To this end, the signal may include a digital code. For example, a thirty-two bit digital word may provide over four billion individual codes so that duplication may be avoided. When such a digital code is provided, multiple individuals wearing the bands may be monitored by a single receiver.

The batteries 60 may be any commercially available, long life, low voltage battery. High density, lithium thionyl chloride cells that produce an average of about 750 mAH have proven to be acceptable sources of power for as long as nine months. Two such cells may be placed in series to provide about seven volts. Such batteries are commercially available as Eagle Picher LTC-7PN.

The batteries 60 may be contained in a molded, hard plastic shell 70 that may be affixed to the case 65. The shell 70 may be removed and discarded when the battery 60 is no longer effective. The shell 70 and case 65 may have suitable attachment devices such as snaps or screws that may include features for preventing removal of the shell 70 while the band 10 is being worn by the individual.

The strap 50 may include a tamper indicating circuit 75 that may be carried internally of the strap 50 to protect and conceal the circuit 75. The circuit 75 may include copper (or other suitable material) conductive traces extending the length of the strap that provide an indication to the transmitter when the circuit has been cut, such as when the individual wearing the band attempts to remove the band by cutting or otherwise removing a portion of the strap 50. The tamper indicating circuit 75 should be flexible so as not to disrupt operation of the circuit when the band is wrapped around an ankle, wrist or personal article of the individual. A Kapton TM flex circuit has found to be an acceptable tamper indicating circuit.

The tamper indicating circuit 75 may be internally carried by the strap 50 by placing the circuit in the injection mold for the strap before the strap 50 is formed.

Figure 5:
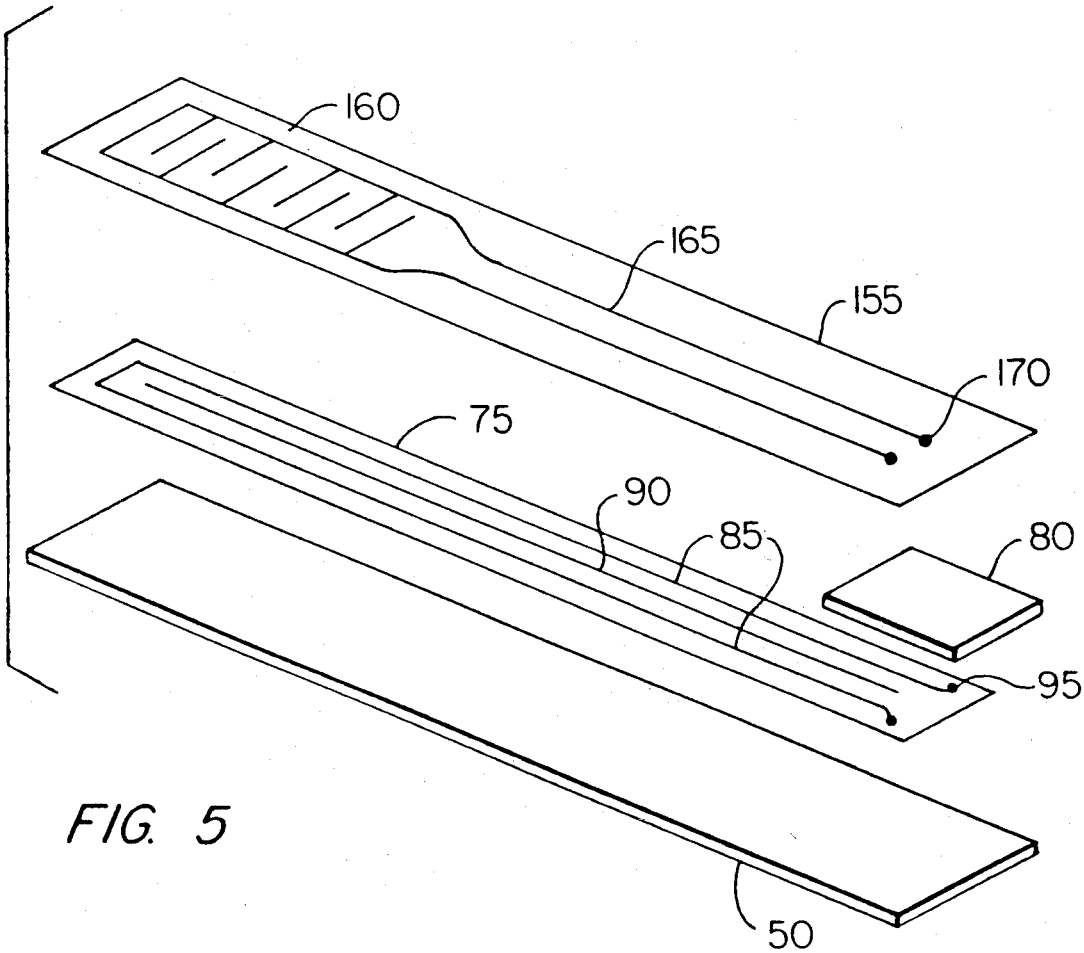
FIG. 5 is a pictorial representation of an exploded view of a strap for the band of the present invention.

With reference now to FIG. 5, the tamper indicating circuit 75 may be connected to a circuit board 80 carried by the transmitter 55 or otherwise located in the case 65. Conductive traces 85 in the tamper indicating circuit may be terminated at pins 95 and may be soldered to the circuit board 80. The tamper indicating circuit 75 may also include inoperable traces 90 among the operable traces 85 to conceal the operable traces and to increase the level of difficulty for one attempting to short circuit the tamper indicating circuit 75.

With reference again to FIGS. 2, 3, and 4, the band 10 may also include a latch 100. The latch 100 may provide both tamper resisting and tamper indicating features. Further, it may provide an unlimited number of sizes for a high degree of comfort for the wearer by using compression to hold the ends of the strap together. The latch 100 may be permanently affixed to the strap 50 using a suitable method such as small bolts 105 that may be flush with the surface of the strap. The latch may also include an "S" shaped tongue 110 that may be attached to a latch frame 115. The frame 115 may include two generally parallel sides 120 positioned adjacent opposing edges of the strap 50 and a base 125 underlying the strap 50 and connecting the two sides 120. The side of the base 125 nearest the wearer of the band may be covered with a protective coating 130.

The tongue 110 may be pivotably attached to the frame 115 inside one of the curved ends of the "S" shape of the tongue 110. To this end, the tongue 110 may be attached to a bolt 135 extending through both sides 120. The other curved end of the tongue 110 may be lifted away from the strap when the latch 100 is to be opened and pushed towards the strap when the latch is to be closed. To hold the latch in the closed position and resist tampering therewith, a bolt 140 may be inserted through corresponding holes 142 in sides 120 and through the curved portion of the tongue 110. When the bolt 140 has been inserted a cap 145 may be affixed thereto to prevent removal of the bolt. The cap and bolt may include security features to prevent inadvertant or unknowing removal of the bolt by the wearer, such as a lock and key, uniquely designed socket and wrench or other means known in the art.

When the free end 51 of the strap 50 is inserted in the latch 100 and the latch 100 is closed, a portion 148 of the tongue 110 adjacent the bolt 135 applies pressure to the strap 50. The applied pressure should be sufficient to prevent removal of the strap, which may include a suitable retainer 150 near end 51 to further resist removal of the strap. The use of pressure to hold the strap 50 closed about a part of the individual provides an unlimited number of sizes and avoids the use of holes in the strap that may increase manufacturing costs or interfere with the tamper indicators embedded in the strap.

The end of the strap 50 to which the latch 100 is attached may include a pressure sensor 155. The pressure sensor 155 may be operably connected to the circuit board 80 to indicate when pressure is being applied to the sensor 155 by the tongue 110. With further reference to FIG. 5, the pressure sensor may include a pressure pad 160 and conductors 165 connecting the pad 160 to the tamper circuit 80 through pins 170. The absence of pressure on pressure pad 160 indicates that the latch 100 is open. It has been found that the force sensitive resistor manufactured by Interlink Electric of Santa Barbara, Calif. provides an acceptable pressure sensor.

Figure 6:
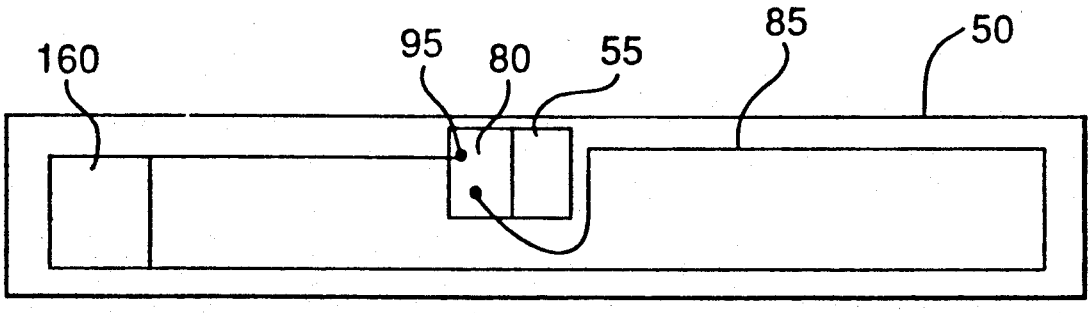
FIG. 6 is a schematic diagram of an alternative embodiment of the tamper features of the band of the present invention.

The pressure sensor 155 may be carried internally of the strap 50 and may be placed in the injection mold for the band with the tamper indicating circuit 75 so that the pressure sensor 155 and the circuit 75 may be protected and concealed when the band is molded. The pressure sensor 155 may be separate from the tamper indicator circuit 95 as seen in FIG. 5 or, preferably, may be integrated therewith as seen in FIG. 6. The traces 85 in the tamper indicating circuit 75 may be used instead of conductors 165 to connect the pressure pad 160 to the circuit board 80 and/or transmitter 55 to reduce manufacturing costs and to decrease the thickness of the band 50.

The circuit board 80 may direct transmitter 55 to send an appropriate signal or stop sending a signal altogether when either the tamper indicating circuit 75 or the pressure sensor 155 indicates that the device has been removed or that tampering has occurred.

Figure 7:
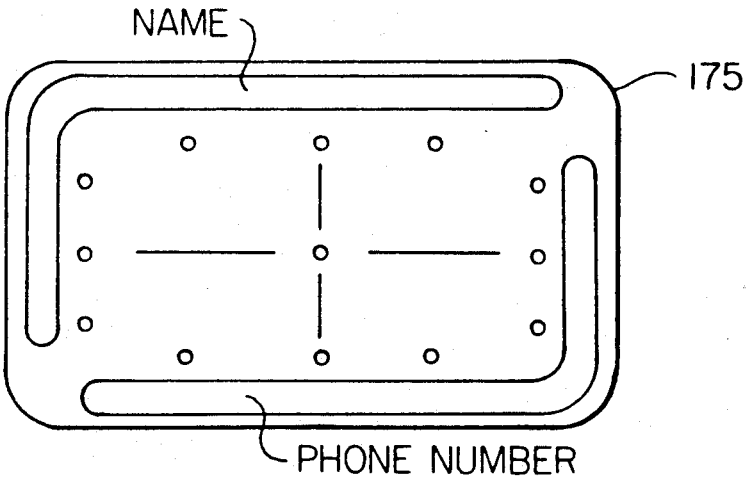
FIG. 7 is a pictorial representation of an embodiment of a cover for the band of the present invention.

The exposed face 172 of the shell 70 may include appropriate information about the wearer of the band and decorations, such as colors and designs, that may be recognized and liked by the wearer. As may be seen in FIG. 7, the decoration may include a watchface 175 and the name of the patient and a phone number of the caregiver or of a central reporting station that may operate nationwide to assist in the return of the individual. Several covers having various decorations may be provided so that the wearer may select the most pleasing.

The Monitoring/Tracking Unit

The monitoring/tracking unit of the present invention provides the caregiver in the home with the ability to monitor when the individual has wandered out of a predetermined area and to provide an indication of the direction to that individual.

With reference again to FIG. 1, the monitoring/-tracking unit 20 may include a selector 205 for turning the unit off and for selecting one of two modes, a monitoring mode and a tracking mode. A security mechanism, such as a lock, may be provided in the selector 205 to prevent unauthorized movement of the selector 205. This feature may be used, for example, to prevent the individual from turning the unit off or deselecting the monitoring mode when left home alone. The key may be removed and retained by the caregiver. As will be discussed in more detail below, the monitor mode provides for omnidirectional reception of the identifying signal transmitted from the band and for the sounding of an alarm when that signal has not been identified for a predetermined period of time. In the tracking mode the alarm may be disabled and a directional antenna used to provide an indication of the direction to the individual wearing the band.

The unit 20 may include antennae 25 and 30 for directional and omnidirectional reception of the signal from the band. A traditional monopole antenna of appropriate length may be used for omnidirectional reception. A rotatable directional antenna, such as a loop antenna 30, may be used to indicate a direction to or from the individual wearing the band. Antennae 25 and 30 may each have their own connections to the unit 20 or may be used interchangeably in a common connector 210. The unit 20 may have visual and/or aural indications of signal strength that may be used with the directional antenna. A signal strength indicator 215 and the directional antenna 30 may be disabled in the monitor mode.

Figure 9:
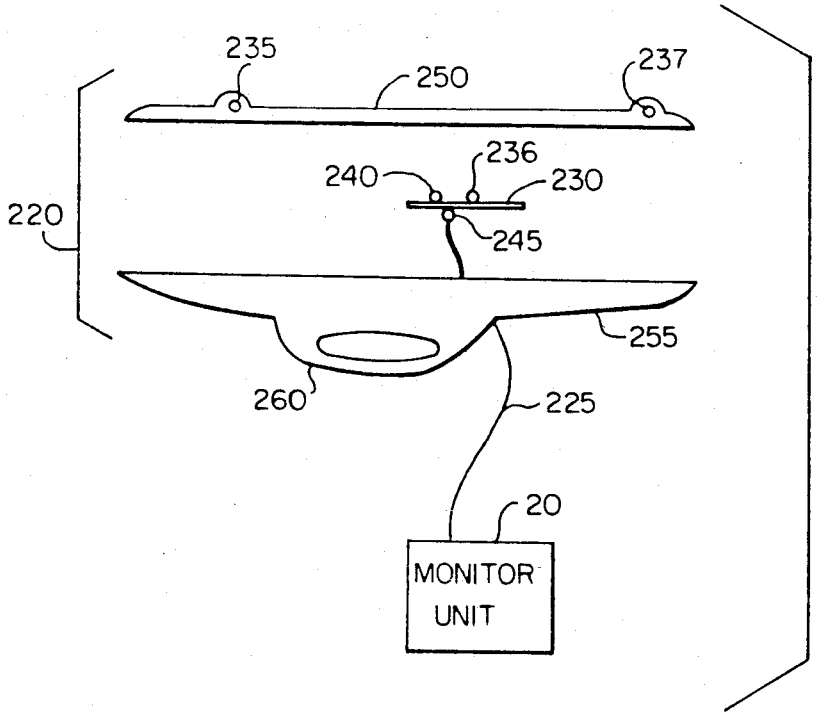
FIG. 9 is an exploded partial pictorial representation of a side view of the embodiment of the direction finding antenna of FIG. 8.
Figure 8:
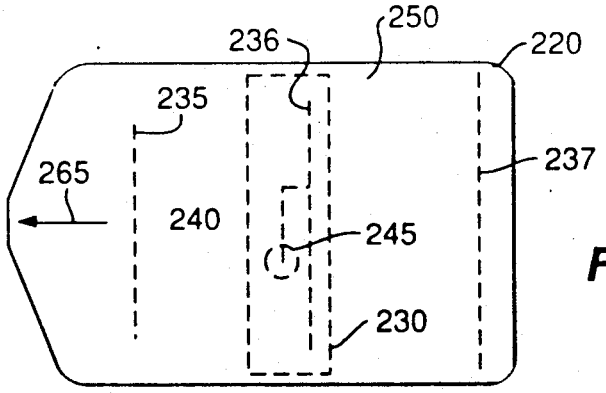
FIG. 8 is an overhead pictorial representation of an embodiment of a direction finding antenna that may be used in the system of the present invention.

With reference to FIGS. 8 and 9, a preferred embodiment of the directional antenna of the present invention may include a hand operated antenna 220 that may be connected to the monitoring/tracking unit 20 with appropriate coaxial cable 225. The antenna 220 may include a generally planar ground plane 230 that may be adapted to be hand carried horizontally. The coaxial cable 225 may also have provisions for grounding the ground plane element 230 of the antenna.

The directional antenna 220 may include plural antenna elements 235–237 that may be linear and generally coplanar and parallel.

The interior antenna element 236 may be operably connected to an active element 240 that may be connected through the coaxial cable 225 and a capacitor 245 to the monitoring/tracking unit 20. The remaining elements 235 and 237 are passive and are not connected to antenna element 236 or to the active element 240. Passive elements 235 and 237 may be placed on either side of the active element to focus the incoming radio frequency energy. The elements 235–237 may be approximately one-half the wavelength of the RF signal long and spaced apart from each other one-quarter wavelength. For example, when the transmitted frequency emitted is 480 MHz each element may be approximately 11" long and spaced 5½" apart. If a smaller antenna is desired, a higher frequency, such as 900 MHz may be used. A capacitor of 4.7 pf may be provided. Each element may be formed from appropriate material, such as 16 gauge spring steel.

To provide an indication of direction to the individual the elements 235–237 may have increasing lengths (elements of equal length provide an indication of direction to or from the individual). For example, element 235 may be about 5% shorter and element 237 about 5% longer than element 236 to produce a front-to-back ratio of about 1:1.1 (11.0, 11.7 and 12.3 inches, respectively, for 480 MHz).

With reference to FIG. 9, the ground plane 230 of the antenna and the elements therein may be protected and supported by covers 250 and 255. The covers 250 and 255 may be formed from a lightweight material with appropriate strength, such as plastic. The antenna elements 235 and 237 may be positioned in indentations in the cover 250 and held in place with an adhesive such as glue. Ground plane 230 and components therein may be positioned in an indentation in cover 255 and held therein when the two covers are joined. The cover 255 may include a handle 260 to enable manual manipulation of the antenna 220. An arrow 265 perpendicular to the elements 235–237 may be added to indicate the direction to the individual. If additional antenna gain is desired, additional appropriately spaced-apart and generally parallel passive antenna elements not connected to element 236 or active element 240 may be added between element 235 and the arrow 265.

In operation, antenna 220 may be manually rotated in a horizontal plane until a relative maximum signal strength is achieved. Upon detection of such relative maximum the monitoring unit 20 and the antennae 220 may be moved in the direction indicated by the arrow 265 and the process repeated until the individual has been located.

Figure 10:
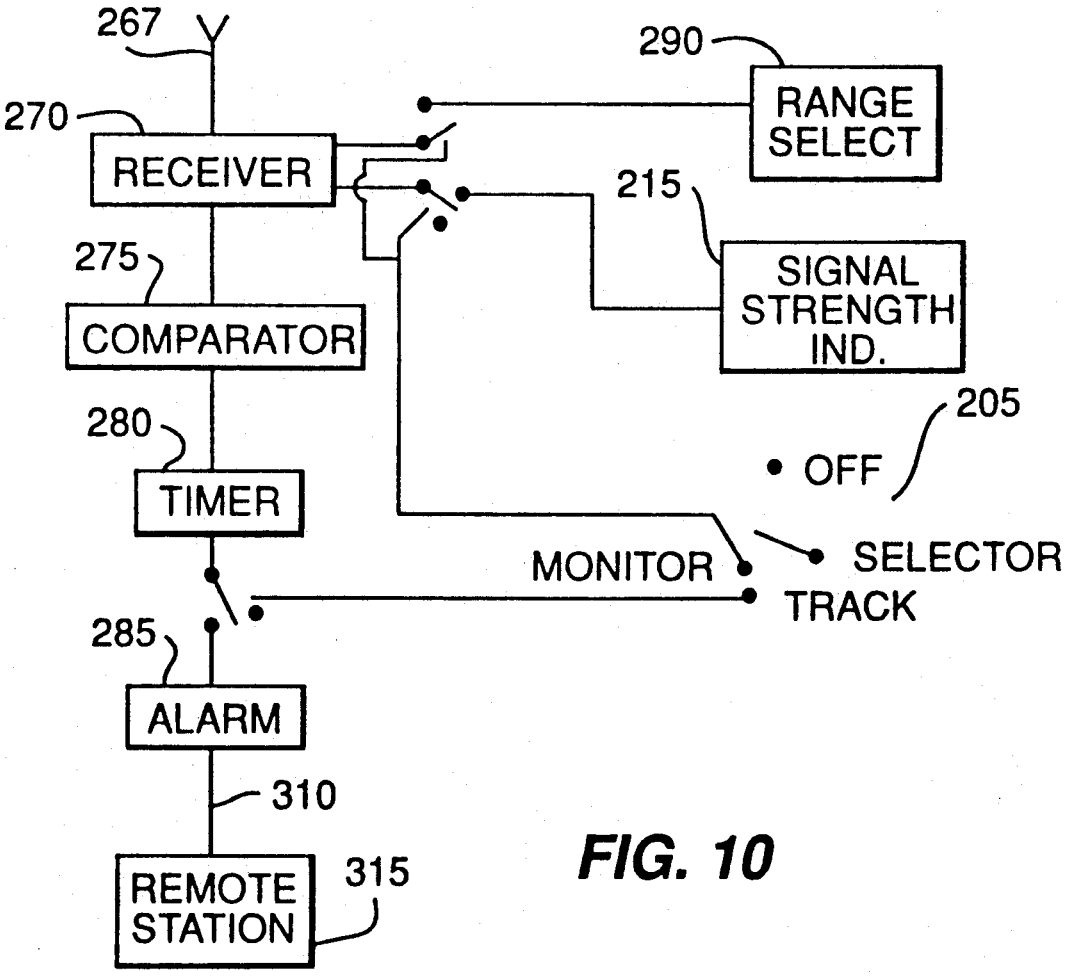
FIG. 10 is a functional block diagram of the monitoring/tracking unit of the present invention.

With reference now to FIG. 10, the identification signal received at the antenna 267 may be communicated to receiver 270 where the data in the signal may be placed in digital form. The resulting digital signal may be communicated to comparator 275 where it may be compared to a predetermined identifier that is associated with the individual whose location is to be monitored. When the digital signal matches the predetermined identifier the comparator 275 generates an indication that the individual is within the predetermined area. This indication may be, for example, a small voltage that may be sent to timer 280. Upon receipt of the voltage, the timer 280 is reset. As long as the individual is within the predetermined area and signals are received and positively compared, the timer will be reset as often as the identifying signal is transmitted. When a proper signal has not been received, however, the timer will not be reset and will continue to run. After a predetermined period of time, the timer 280 sends a signal to alarm 285 indicating that the appropriate identification signal has not been received for the predetermined period of time. The alarm 285 may include visual, aural and/or telephonic devices for alerting the caregiver or other appropriate individuals.

With further reference to FIGS. 1 and 10, the unit 20 may also include provisions in the tracking mode for enabling a range selector 290 and the signal strength indicator 215, and for disabling the timer 280 and/or alarm 285. The range selector 290 allows the operator of the unit 20 to adjust the sensitivity of the receiver 270. For example, when the operator is tracking an individual who has wandered away from their home, the operator may wish to select a receiver sensitivity for short-range reception. After unsuccessfully completing a search with the directional antenna at this sensitivity setting, the next sensitivity setting may be selected, and so on until the individual is located. When the individual has been located at long range the unit may be moved in the direction indicated and the sensitivity set for a shorter range. A signal strength indicator may also be enabled in a tracking mode. The indicator may provide aural and/or visual indications of signal strength. The signal strength indicator may be set to sound or flash when the proper identification signal has been received. This feature may be particularly helpful when the time period between transmissions of the identification signal may be long (e.g., 10 seconds).

When the present invention is to be used to monitor the location of more than one individual, such as in a nursing home, the range selector 290 may be used to vary the size of the predetermined area in which the individuals may move. For example, a short range setting may be used at night and a longer range during the day.

Figure 11:
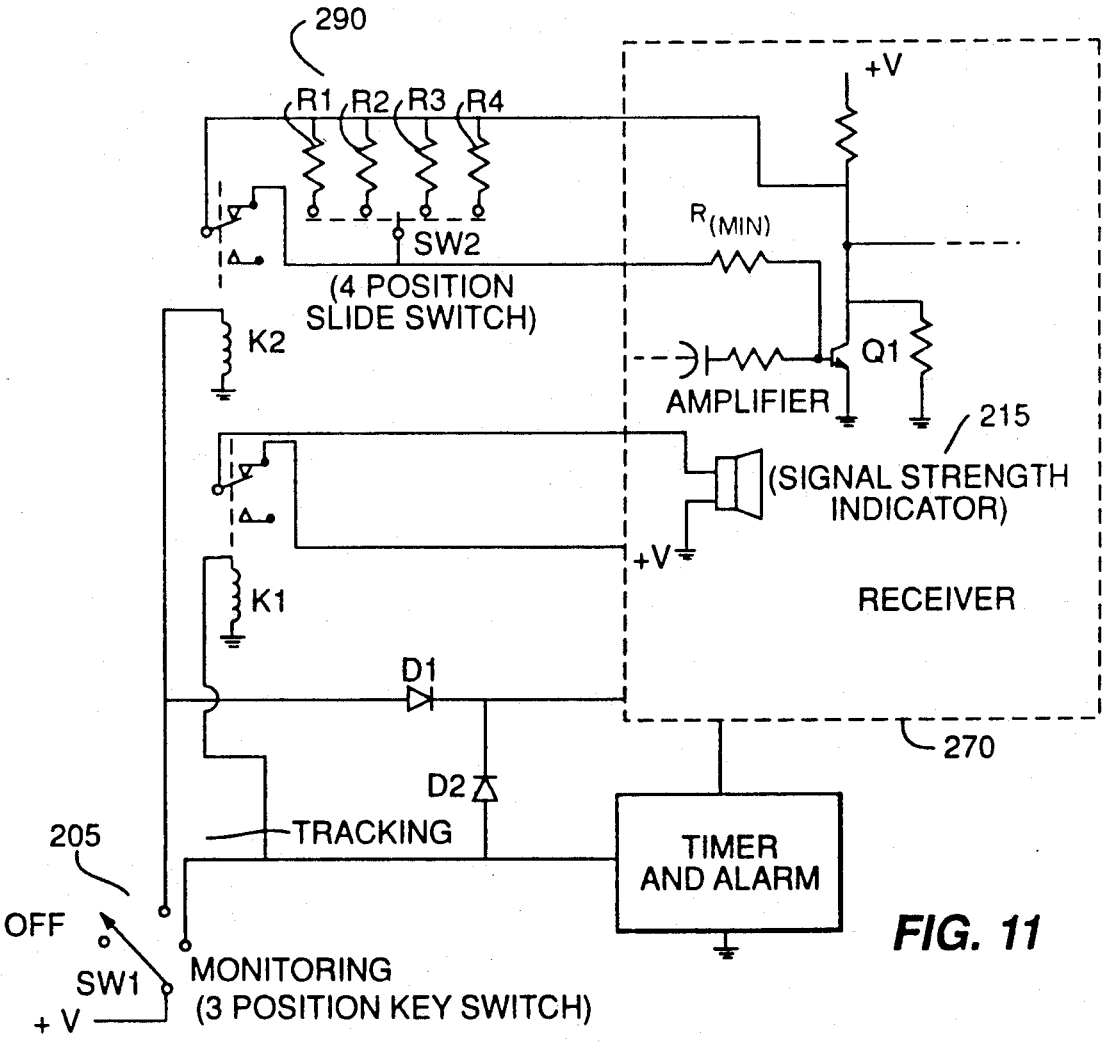
FIG. 11 is a partial circuit diagram of the receiver, range selector and signal strength indicator which may be used in the embodiment of FIG. 10.

With reference now to FIG. 11, the operation of the receiver 270, mode selector 205 and range selector 290 may be seen in more detail. A three position key switch SW1 controls the operating mode of unit 20. In the OFF position all power is removed from the system preventing all circuits from functioning. In the tracking mode, power is applied to the receiver via diode D1. Relay K2 is also energized shunting the range switch SW2 (which may be a four position slide switch) and range resistors R1, R2, R3 and R4. Range adjustment is accomplished by varying the base-to-collector resistance of the amplifier transistor Q1; the larger the base-to-collector resistance the higher the amplifier gain and the greater the range. When the monitoring mode has been selected, power is applied to the timer and alarm and to the receiver via diode D2. The relay K1 is energized disabling the signal strength indicator. The diode D1 is back-biased in this mode and relay K2 is deenergized. While in this position the shunt provided by relay K2 sets the minimum range which is controlled by resistor R(min).

Figure 12:
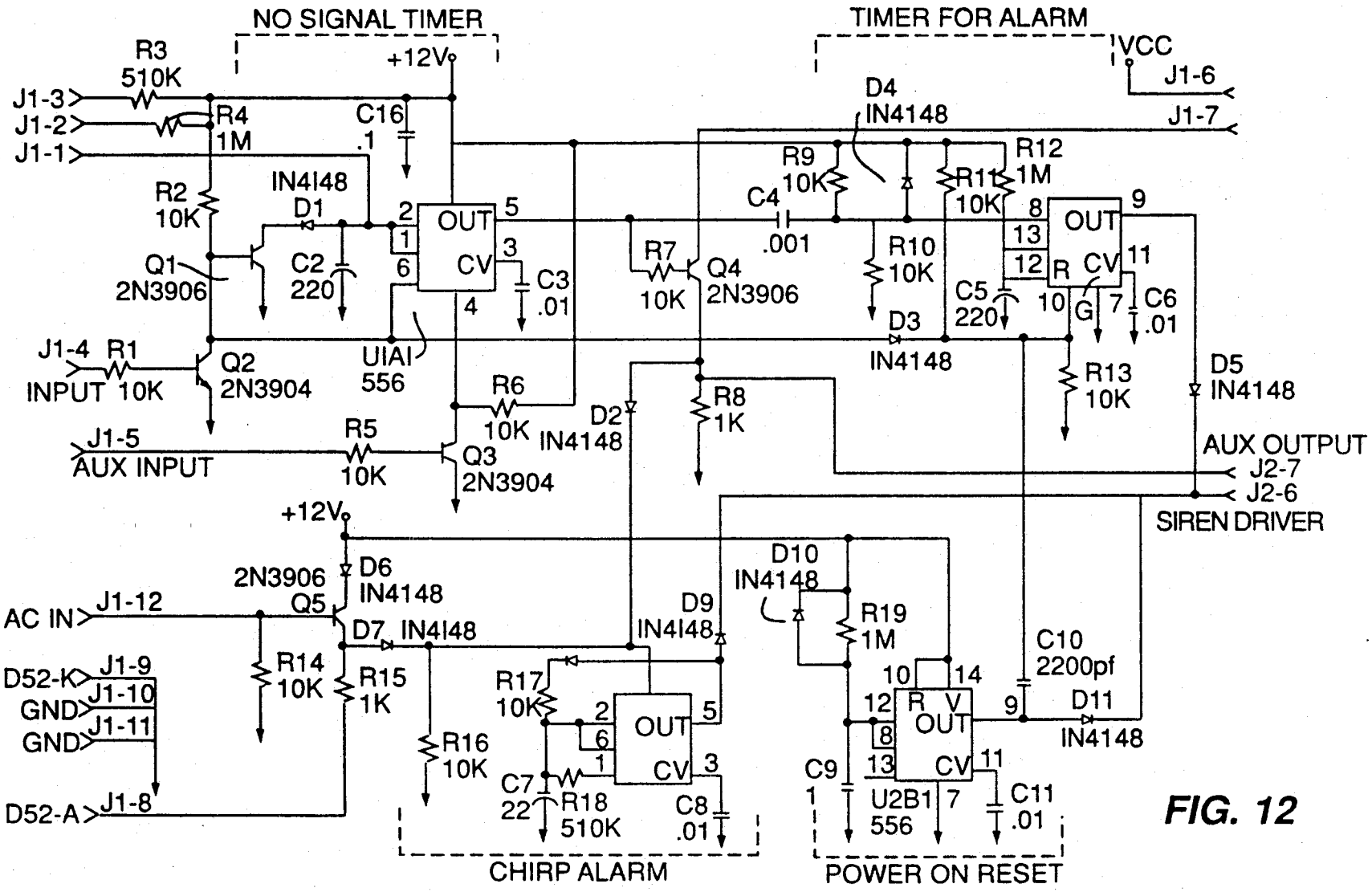
FIG. 12 is a circuit diagram of the timer and alarm which may be used in the embodiment of FIG. 11.

With reference now to FIG. 12, an embodiment of the circuitry for the timer and alarm may be seen. In addition to the timer circuitry for indicating that the identification signal has not been received for a predetermined period of time, timer circuits for terminating the alarm after a predetermined period of time and for providing a chirp alarm thereafter may be included. For example, the alarm may sound continuously for four minutes followed by a chirp alarm every 30 seconds.

With reference again to FIG. 1, unit 20 may include provisions for a source of AC power 305 and indicator lights for indicating that the AC power is out and that the power is being supplied to the unit from either the AC power source or the batteries 35.

Figure 13:
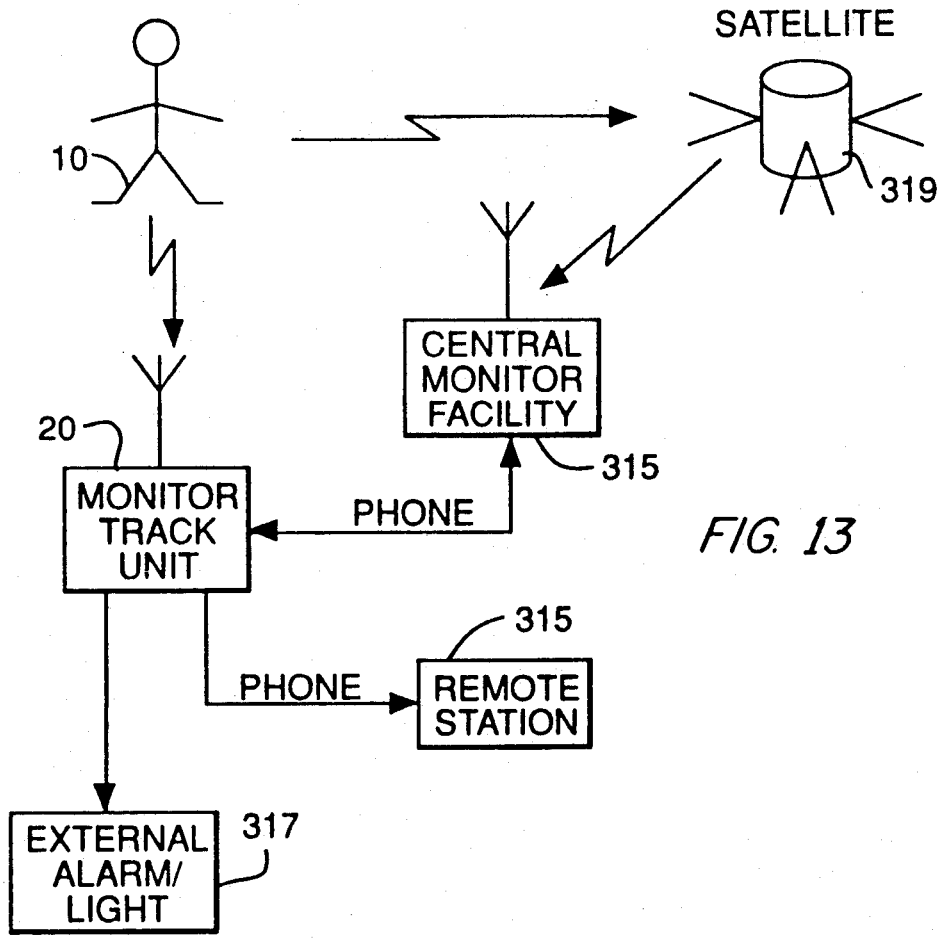
FIG. 13 is a partial pictorial representation and partial block diagram of an alternative embodiment of the system of the present invention.

A further embodiment of the present invention may include connections 310 to a telephone system. As may be seen in FIGS. 10 and 13, alarm 285 may be connected to a remote station 315, such as a neighbor's house or at a central facility for monitoring a multiplicity of alarm units. Each remote station may include its own alarm for indicating when the individual has wandered away from the predetermined area. To this end, alarm unit 285 may include an automatic dialer and modem for making the telephone connection. The unit 20 may also be used to activate external sirens and emergency flashing lights 317 as appropriate.

In a further embodiment of the present invention (FIG. 13), one or more satellites 319 may be used to monitor the identification signals from bands 10. As each band has a unique identification code, satellites can be used to triangulate the position of an individual and to notify the caregiver or the appropriate authorities. The caregiver could then use the direction finding functions of unit 20 to locate the individual.

As seen in FIG. 1, unit 20 may also include provisions for detection of a smoke detector alarm. To this end, unit 20 may include a separate unit 320 for sensing the smoke detection alarm and appropriate connections to unit 20, or unit 20 may include such detection devices internally. Unit 20 may further pass the smoke detection signal via phone line 310 to remote station 315. By so doing, an additional level of protection is afforded to the elderly patient at home who may not be able to remove themselves from the scene of the fire.

When the unit 20 is operated with a remote station 315, unit 20 may send status information periodically and/or upon the change of status. For example, the following conditions may be reported to the remote station: unit 20 turned on, no AC power, batteries low, transmitter out of range, transmitter back in range, transmitter removed (tamper indication), fire alarm, phone line out or provisions for other alarms (e.g., user initiated medical alert).

While preferred embodiments of the present invention have been described, it is to be understood that the embodiments described are illustrative only and that the scope of the present invention is to be defined solely by the appended claims when accorded a full range of equivalents, many variations and modifications naturally occurring to those skilled in the art from a perusal thereof.

I claim:

1. A personnel location monitoring system for indicating when an individual is no longer in a predetermined area and for providing an indication of the direction to the individual, the system comprising:

(a) a band adapted to be worn by an individual comprising, (1) a transmitter for periodically transmitting on a predetermined frequency a digital signal uniquely identifying the individual wearing the band, (2) a strap for carrying the transmitter and adapted to be removably affixed to the individual by encircling a part of the individual, (3) at least one tamper detector carried internally of the strap substantially along its length for indicating to the transmitter that a portion of the strap may have been removed, (4) a latch with pressure sensing means for holding the strap encircling a part of the individual when the latch is closed and for indicating to the transmitter that the latch is not applying pressure to the pressure sensing means when the latch is open; and (b) a monitoring/tracking unit comprising, (1) selector means for selecting one of a monitoring mode and a tracking mode, said selector means having secure means for preventing unauthorized deselection of the monitoring mode, (2) antenna means for omnidirectional and directional reception on the predetermined frequency, (3) receiver means connected to the antenna means for receiving a signal on the predetermined frequency and for indicating the signal strength thereof, (4) a comparator for comparing data in the received signal to a predetermined identifier that uniquely identifies the individual whose location is to be monitored and for providing a predetermined voltage when the data in the received signal matches the predetermined identifier, (5) a timer operably connected to the comparator that is reset by receipt of the voltage for providing an indication that the voltage has not been received for a predetermined period of time after the timer has been reset, (6) alarm means responsive to the indication that the timer has not received the voltage for a predetermined period of time for indicating that the individual may not be in the particular area, (7) means for disabling the timer when the tracking mode is selected, (8) means for providing an indication that the signal strength of the received signal exceeds a predetermined level when the tracking mode is selected.

2. The system as defined in claim 1 wherein said pressure sensing means comprises a force sensitive resistor carried internally of the strap.

3. The system as defined in claim 1 further comprising inoperative ones of said tamper detectors for concealing an operative said tamper detector.

4. The system as defined in claim 1 further comprising a removable battery pack for carrying at least one battery to provide power to the band.

5. The system as defined in claim 1 wherein the digital signal comprises a thirty-two bit data word.

6. The system as defined in claim 1 further comprising plural covers for said transmitter whereby colors and designs as may be pleasing to the patient may decorate said transmitter.

7. The system as defined in claim 1 further comprising satellite means for receiving a signal on the predetermined frequency and for providing a second signal that can be used to determine an approximate location of an individual wearing said band.

8. A band for a personnel location monitoring system, the band to be worn by an individual whose location is to be monitored, the band comprising:

(a) a transmitter for emitting a signal;

(b) a strap for carrying the transmitter and adapted to be removably affixed to an individual;

(c) a force sensitive resistor carried by the strap and operably connected to the transmitter for indicating the presence of pressure on the resistor; and (d) a latch for applying pressure to the force sensitive resistor when the latch is closed, and for affixing the strap to the individual when the latch is closed, whereby the transmitter indicates pressure is not being applied to the force sensitive resistor when the latch is open.

9. The band as defined in claim 8 wherein the transmitter transmits the signal at predetermined time intervals.

10. The band as defined in claim 8 wherein the transmitter transmits the signal at time intervals of randomly varying length.

11. The band as defined in claim 8 further comprising means for synchronizing the signal with a second signal transmitted from another said band so that the signals are not being transmitted at the same time.

12. The band as defined in claim 8 further comprising a pin for holding the latch closed, the pin having means for being securably retained in said latch.

13. In a personnel location monitoring system having a band adapted to be worn by an individual, the band having a transmitter for emitting a signal, a strap for carrying the transmitter and means for indicating tampering with the band, the improvement wherein the means for indicating tampering comprises;

a force sensitive resistor carried internally of the strap; and a latch for holding the strap on an individual whose location is to be monitored, the latch applying pressure to the force sensitive resistor only when the latch is closed, whereby the transmitter indicates that pressure is not being applied to the force sensitive resistor when the latch is open.

14. A monitoring/tracking unit for use with a personnel location monitoring system, wherein the individual whose location is to be monitored carries a transmitter transmitting an identification signal on a predetermined frequency, the unit comprising:

(a) selector means for selecting one of a monitoring mode and a tracking mode;

(b) a first antenna for omnidirectional reception on the predetermined frequency;

(c) a second antenna for directional reception on the predetermined frequency;

(d) receiver means operably connected to one of said first and second antennas for receiving and indicating the signal strength of a received signal;

(e) comparing means for indicating that the received signal is the identification signal;

(f) a timer operably connected to the comparing means for indicating that the identification signal has not been received for a predetermined period of time;

(g) alarm means responsive to the timer for providing an alarm indication that the identification signal has not been received for a predetermined period of time;

(h) a self-contained source of power that may be used in the tracking mode;

(i) means for providing an indication that the signal strength of the identification signal exceeds a predetermined level when in the tracking mode; and (j) means for disabling the alarm means when in the tracking mode, whereby the first antenna may be used in the monitoring mode to determine when the identification signal from the individual whose location is to be monitored is not being received, and whereby the unit may be portably used with the second antenna in the tracking mode to determine a direction to the individual.

15. The unit as defined in claim 14 wherein the first and second antennae interchangeably use a common connector.

16. The unit as defined in claim 14 wherein the first antenna is selected when the monitoring mode is selected and the second antenna is selected when the tracking mode is selected.

17. The unit as defined in claim 14 further comprising a second station remote from the unit and means for notifying the second station when the alarm means indicates that the identification signal has not been received for a predetermined period of time.

18. The unit as defined in claim 17 further comprising means for alerting the second station when power is not being provided to the unit in the monitoring mode.

19. The unit as defined in claim 17 further comprising means for determining when a smoke alarm has been initiated in the vicinity of the unit and means for alerting the second station that the smoke alarm has been initiated.

20. The unit as defined in claim 14 wherein plural individuals each carry one said transmitter, each transmitting a unique said identification signal on the predetermined frequency, the unit further comprising means for identifying the unique identification signal that has not been received for a predetermined period of time.

21. The unit as defined in claim 14 further comprising means for selectably adjusting the signal strength at which the identification signal may be indicated by the comparing means.

22. In a personnel location monitoring system having a monitoring unit for determining when an individual whose location is to be monitored is not in a predetermined area, the improvement wherein the monitoring unit comprises:

(a) a selector for selecting one of a monitoring mode and a tracking mode;

(b) two antennas, a first antenna for omnidirectional reception when the monitoring mode has been selected and a second antenna for directional reception when the tracking mode has been selected;

(c) a self-contained power source for use when the tracking mode has been selected;

(d) means for providing an alarm when the identifying signal has not been received for a predetermined of time that is disabled when the tracking mode has been selected; and (e) means for indicating that a received identifying signal has a predetermined signal strength when the tracking mode has been selected, whereby the unit may be used at a fixed location for determining when an individual is not in a predetermined area, and whereby the unit may be portably used for determining the direction to the individual.

23. In the improved monitoring unit defined in claim 22, the further improvement comprising satellite means for receiving the identifying signal and for providing a second signal that can be used to determine an approximate location of an individual wearing said band.

24. In a personnel location monitoring system having a transmitter emitting a signal of predetermined wavelength and a monitoring unit for receiving the signal, the improvement wherein the system includes a directional antenna for indicating the direction to the transmitter, the antenna comprising:

(a) a generally planar ground plane carrying an active antenna element operably connected to the monitoring unit and a first passive antenna element connected to the active element;

(b) second and third passive antenna elements generally parallel to said first passive element and not operably connected thereto, said first passive element being separated from said second and third passive elements by a distance approximately one-quarter the predetermined wavelength;

(c) generally planar support means for protecting and supporting said three passive elements, said support means being coplanar with said ground plane; and (d) handle means connected to said support means for manipulating said ground plane to achieve a relative maximum signal strength of the signal so that a direction to or from the transmitter may be indicated.

25. The antenna as defined in claim 24 wherein one of said three passive elements has a length approximately one-half the predetermined wavelength and said second and third passive antenna elements are slightly longer and shorter, respectively, than said first passive element so that a direction to the transmitter may be indicated.

26. A method of monitoring and tracking an individual carrying a transmitter emitting an identification signal comprising the steps of:

(a) selecting a monitoring mode on a monitoring unit;

(b) receiving the identification signal on an omnidirectional antenna in the monitoring unit;

(c) comparing the identification signal to a predetermined identifier for the individual stored in the monitoring unit;

(d) resetting a timer when the received identification signal is the same as the predetermined identifier;

(e) providing an alarm signal when the timer indicates that a predetermined period of time has passed since the timer was reset;

(f) selecting a tracking mode on the monitoring unit;

(g) providing a self-contained source of power for the monitoring unit so that it may be moved to track the individual;

(h) receiving the identification signal on a directional antenna in the monitoring unit;

(i) indicating that the signal strength of the received identification signal exceeds a predetermined level;

(j) manipulating the directional antenna so that the predetermined level of signal strength may be achieved and a direction to the individual indicated; and (k) moving the monitoring unit in the indicated direction to track the individual.

27. The method of monitoring and tracking an individual as defined in claim 26 further comprising the steps of:

(l) receiving the identification signal by satellite means;

(m) determining from the identification signal received by the satellite means the approximate location of an individual carrying the transmitter; and (n) indicating the approximate location of the individual so that the monitoring unit may be moved thereto to track the individual.

* * * * *